US011472672B2

(12) United States Patent
Blaiotta

(10) Patent No.: US 11,472,672 B2
(45) Date of Patent: Oct. 18, 2022

(54) ELEVATOR DOOR SAFETY SYSTEM

(71) Applicant: Columbia Elevator Products Co., Inc., Bridgeport, CT (US)

(72) Inventor: Louis J. Blaiotta, Rye Brook, NY (US)

(73) Assignee: Columbia Elevator Products Co., Inc.

( * ) Notice: Subject to any disclaimer, the term of this patent is extended or adjusted under 35 U.S.C. 154(b) by 645 days.

(21) Appl. No.: 16/567,938

(22) Filed: Sep. 11, 2019

(65) Prior Publication Data

US 2021/0070587 A1 Mar. 11, 2021

(51) Int. Cl.

| | |
|---|---|
| ***B66B 13/26*** | (2006.01) |
| ***B66B 13/14*** | (2006.01) |
| ***B66B 13/22*** | (2006.01) |
| ***B66B 5/00*** | (2006.01) |

(52) U.S. Cl.

CPC ..... *B66B 13/26* (2013.01); *B66B 5/0031* (2013.01); *B66B 13/143* (2013.01); *B66B 13/22* (2013.01)

(58) Field of Classification Search

CPC ..... B66B 13/26; B66B 5/0031; B66B 13/143; B66B 13/22

See application file for complete search history.

(56) References Cited

U.S. PATENT DOCUMENTS

| | | | | |
|---|---|---|---|---|
| 6,080,981 | A * | 6/2000 | Payne | G07C 9/00944 250/221 |
| 2004/0075046 | A1* | 4/2004 | Beggs | E05F 15/43 250/221 |
| 2019/0330026 | A1* | 10/2019 | Schmidt | B66B 13/26 |

* cited by examiner

*Primary Examiner* — Jeffrey Donels
(74) *Attorney, Agent, or Firm* — Warshaw Burstein, LLP

(57) ABSTRACT

An elevator door safety system has a motion sensor and a proximity or door sensor defined in a fire-rated elevator entrance assembly. The sensors work together to determine when to open a closing door. The invention further defines a method of controlling an elevator door providing a motion sensor and providing a door sensor, wherein signals from each sensor are sent to a control board to determine when to open elevator doors in response to detecting a person in a detection area in an elevator entrance area.

17 Claims, 7 Drawing Sheets

ELEVATOR DOOR SAFETY SYSTEM

FIELD OF THE INVENTION

The present disclosure is directed to elevator safety. Specifically, the present invention is directed to elevator door safety and use of sensors in regulating the opening and closing of doors.

BACKGROUND OF THE INVENTION

Elevators are ubiquitous in a modern world full of tall buildings and skyscrapers. As time and technology advance, so have elevators. Elevators are used daily by all types of people ranging from families to business people. As the use and need of elevators increase, so does the levels of elevator safety standards. One of the top areas of elevator safety concerns passenger ingress and egress and the opening and closing of elevator doors.

Current technology senses movement behind the car door in the area between the car and entrance door panels. If the car and entrance doors are closing and an object is detected in this area, a signal is sent to the elevator controller to re-open the door. The problem with this technology is that in order to be sensed something must pass the pinch zone. The pinch zone is the area between the entrance door panel and the strike jamb or an opposing panel.

It is common to see people run to closing doors and stretch an arm or object through the pinch zone. By placing something through closing door(s) a light curtain is broken and closing doors should reverse direction and open. Unfortunately, if the arm or object is not sensed the arm/object is likely to get caught, pinched or incur other harm between the doors.

Elevator door safety technology has evolved over the years; however, a need still exists to perfect safety. One solution to this problem could be to install an additional light screen on the hallway face of each entrance. However, the expense equated with and the known difficulty to install such a light hampers the effectiveness of this solution. Also placing a light screen on the hallway face leaves it open to being easily broken by people entering or exiting the elevator.

Another solution could be to use a single pyroelectric infrared (PIR) sensor in the elevator entrance to detect objects moving in an entrance area. The entrance area is the space between the hallway face of the entrance door panel and the hallway face of the entrance frame. The problem with use of a simple PIR sensor alone is that it can be affected by air currents and therefore could result in triggering false reopen signals.

Thus, a need exists to control the opening and closing of automatic elevator doors and permit passengers to safely ingress and egress an elevator car. An invention is desired that will augment current technology and will reduce the chance of false openings. An elevator safety device system is desired that will increase the level of protection for the riding public by reopening doors before a person enters the "Pinch Zone" decreasing the number of pinch related injuries. An elevator safety device system is further desired that can be tailored to each floor and each landing to decrease false triggering of the reopen signal. Furthermore, a safety system is desired to conform to ASME A17.1 and the like and provide protection for passengers entering or exiting an elevator equipped with automatic doors.

An elevator safety device system is also desired that will be mounted in a Underwriters Laboratory (UL) fire-rated entrance such that fire will not penetrate the entrance area. An elevator safety device system is desired that will fit in a head jamb or head jamb and strike iamb in an entrance assembly. What is desired is an elevator safety device system that will be easily installed into existing entrance assemblies with minimal adjustments to existing entrance assemblies.

SUMMARY OF THE INVENTION

An elevator door safety system comprises sensors used to monitor and regulate the opening and closing of doors. The system is disposed in a fire-rated elevator entrance assembly, specifically a head jamb or head jamb and strike jamb. The system can be tailored to each floor landing and open a door if the door has not yet fully closed.

An elevator door safety system has an elevator entrance assembly comprising at least a head jamb and a strike jamb. Disposed in the fire-rated entrance assembly is a motion sensor that detects the presence of at least one person in an entrance area and, in some embodiments, a proximity sensor or door sensor that checks or monitors whether the elevator door is open, closed or not yet closed. In other embodiments, the proximity sensor may be disposed at the strike jamb. The system uses the status of the elevator door to determine if the presence of the person will open the elevator door. In some embodiments, the motion sensor is a PIR which may further include a potentiometer.

The proximity sensor sends signals to a control board on the status of the door, wherein when the door is closed, said proximity sensor signals override PIR signals sent to the control board and the door remains closed. When the door is not closed, the proximity sensor signals allow the PIR signals to be sent to the control board and the control board analyzes said proximity sensor signals and said PIR signals to determine whether to send signals to the relay board to then usher forward signals to the door controller operator to open the door. The control board contains and runs a continuous loop software with a preset timer to determine if the motion sensor is detecting a moving person or object.

The entrance area includes a detection area, which is a distance measured starting from a hallway facing surface of an entrance jamb to a maximum area in the entrance area in which the motion sensor detects the presence of the person. In some embodiments, the detection area or projection area is about 12" in other embodiments, the detection area is defined as a distance defined by ASME code. An adjustor may be used to define a detection area.

The present invention further defines a method of controlling an elevator door by providing a motion sensor disposed on an elevator entrance assembly to detect presence of at least one person in a detection area and providing a door sensor to detect status of the door. Both the motion sensor sends its signals and door sensor sends its signals to a control board. The motion sensor signals are bypassed by the control board when the door sensor sends door closed signals to the control board. However, the motion sensor signals are relayed to an elevator controller by the control board when the door sensor sends door-not-closed signals to the control board whereby the door opens.

DETAILED DESCRIPTION OF THE INVENTION

Figure 1A:
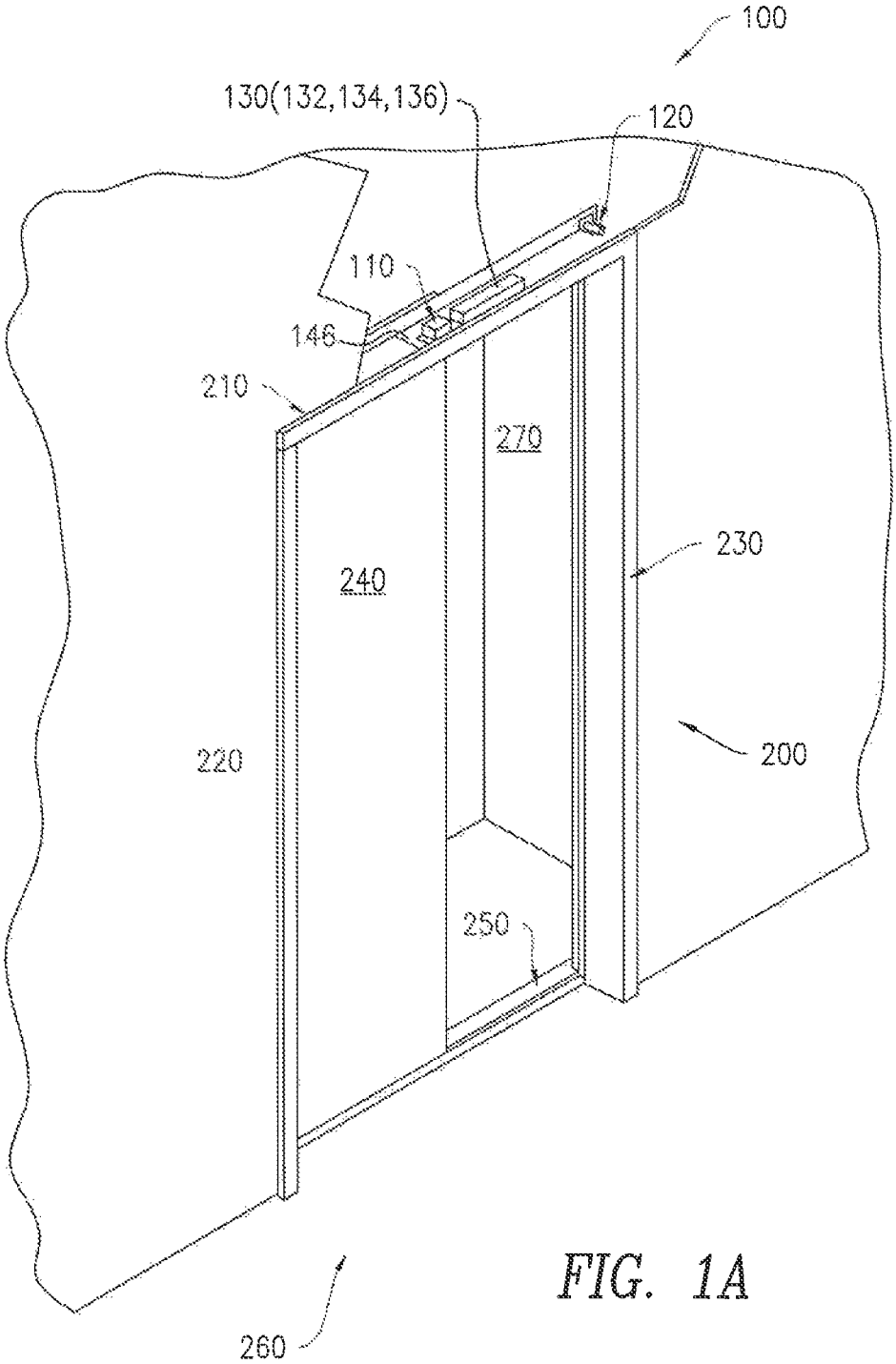
FIG. 1A shows an elevator door safety system 100 of the present invention using a single-slide type of door opening.
Figure 1B:
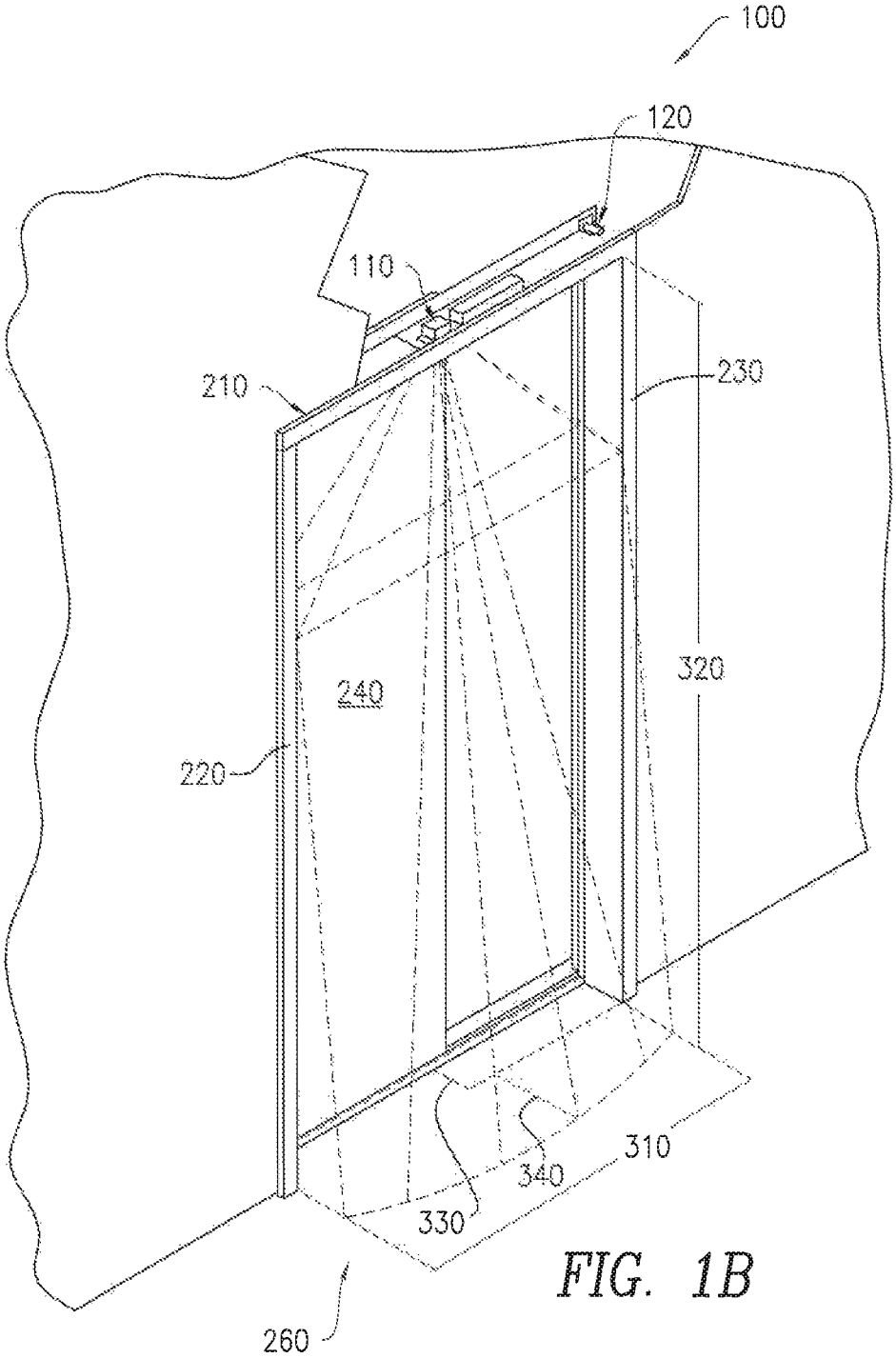
FIG. 1B shows the system 100 showing the entrance area.

FIG. 1 shows an elevator door safety system 100 mounted in a fire-rated elevator entrance assembly 200. The system 100 comprises a motion sensor 110, a door/proximity sensor 120 and, in housing 130, a control board 132, an output relay or relay board 134 and a voltage regulator 136. The system 100 detects the movement of persons in an entrance area 260 of a passenger elevator. The entrance area 260 may be the area both inside and outside of the elevator entrance assembly 200.

The elevator entrance assembly 200 comprises a head jamb 210, return jamb 220, strike jamb 230, door panel(s) 240 and sill 250. Jambs 220, 230 may be collectively called entrance jambs. As shown in FIG. 1, the motion sensor 110 and the housing 130 are mounted the head jamb 210. Specifically, motion sensor 110 is mounted in the center of the head jamb 210 using a fixed aperture plate 146. In one embodiment, the plate 146 may be fixed to the head jamb 210 using tamperproof fasteners such as but not limited to tamperproof screws.

The motion sensor 110 detects movement when a person or object enters the entrance area 260. The size of entrance area 260 is determined in view of entrance width 310, entrance height 320, entrance depth 330 and a projection area 340, also known as detection area. See FIG. 1B. The entrance width 310 is the space between entrance jambs 220, 230. The entrance height 320 is defined as the distance from the floor and/or sill 250 to the head jamb 210. The entrance depth 330 is the distance from the face of door panel 240 to a halfway-facing surface of entrance jambs 220, 230. The entrance depth 330 will vary based on the thickness of an entrance wall on which entrance jambs 220, 230 rest. The projection/detection area 340 is a distance measured from the hallway-facing surface of entrance jambs 220, 230 to a designated point. The projection/detection area 340 is the maximum amount of area to be projected from the elevator entrance. In one embodiment, the projection area 340 will be 12" past the hallway-facing surface of entrance jambs 220. In another embodiment, the projection/detection area 340 will be 18" past the hallway-facing surface of entrance jambs 220. In some embodiments, the projection/detection area 340 will be a safety zone defined, for instance, by ASME code.

Figure 2A:
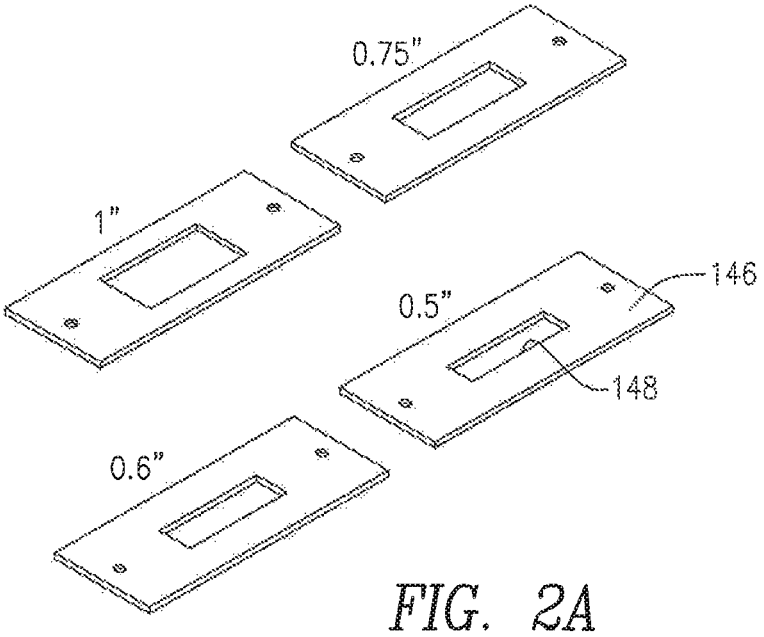
FIG. 2A shows an aperture plate.

The projection/detection area 340 may be defined using an adjustor. In one embodiment, the adjustor is aperture plate 146, see FIG. 2A and the motion sensor 110. The aperture plate 146 limits the detection area or viewing area of the motion sensor 110. As stated above, the aperture plate 146 is mounted in the center of the head jamb 210 due to the working relationship with the motion sensor 110. The fixed aperture plate 146 is a flat face plate with a fixed opening 148 for the motion sensor 110 to emit light, or some sort of detection and sense movement. The fixed opening 148 may be any width from about 0.5" to about 1". For instance, plate 146 may have a fixed opening 148 of 0.6" or even about 0.75" so long as it defines the projection/detection area 340.

Figure 2B:
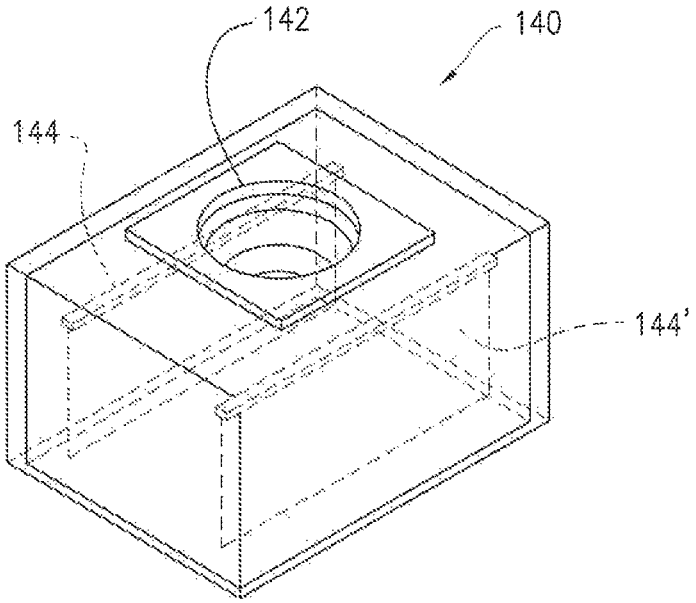
FIG. 2B shows an aperture box.
Figure 2C:
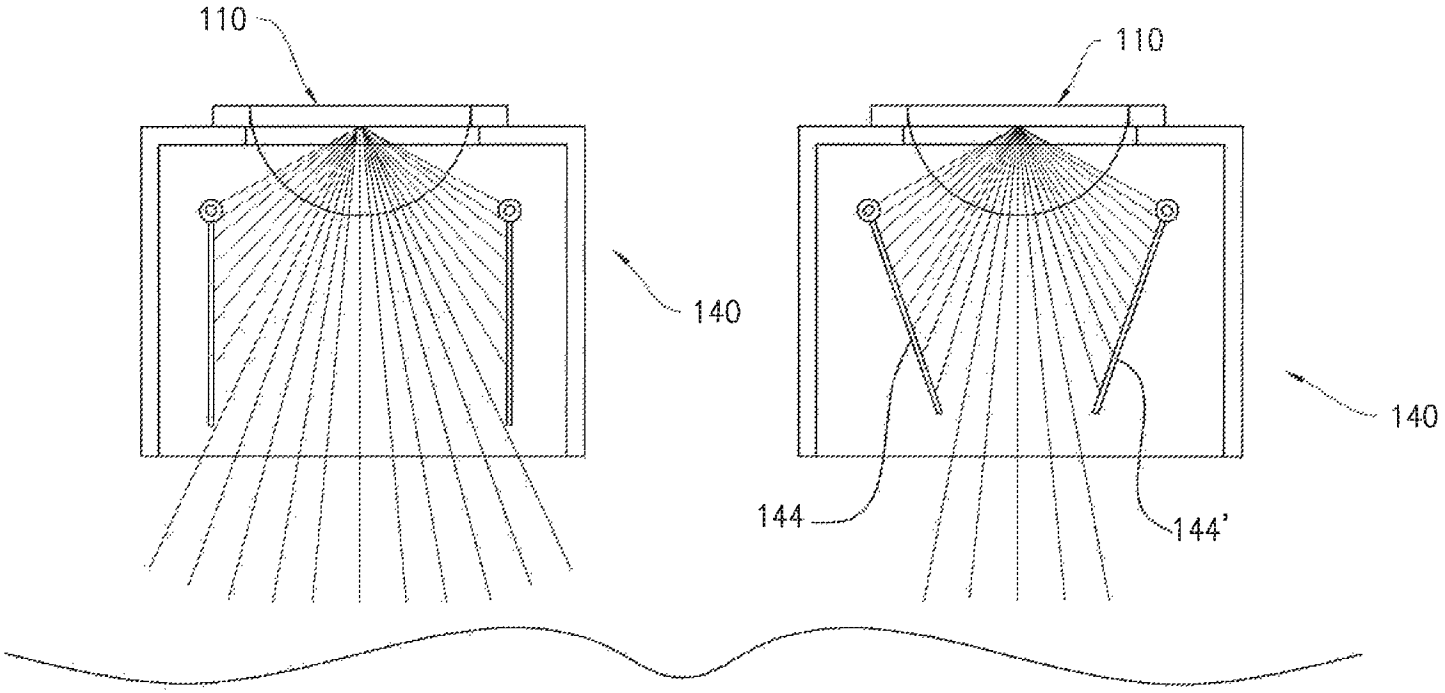
FIG. 2C shows the positioning of the vanes in an aperture box.

In another embodiment, the adjustor is an adjustable aperture box 140 may be used instead of or even in conjunction with the aperture plate 146. See FIGS. 2B and 2C. The adjustable aperture box 140 has a mount 142 on top to receive the motion sensor 110. The box 140 contains moveable vanes 144, 144' which alone or with the aperture plate 146 at the bottom of the box 140 restricts a viewing area of the motion sensor 110 through the bottom of the box. Adjusting the vanes 144, 144' and aperture plate 146 adjusts a projection/detection area 340 of the motion sensor 110. For instance, if a pyroelectric IR sensor is used as the motion sensor 110, IR beams would be controlled by the angle of the vanes 144, 144'.

Figure 3:
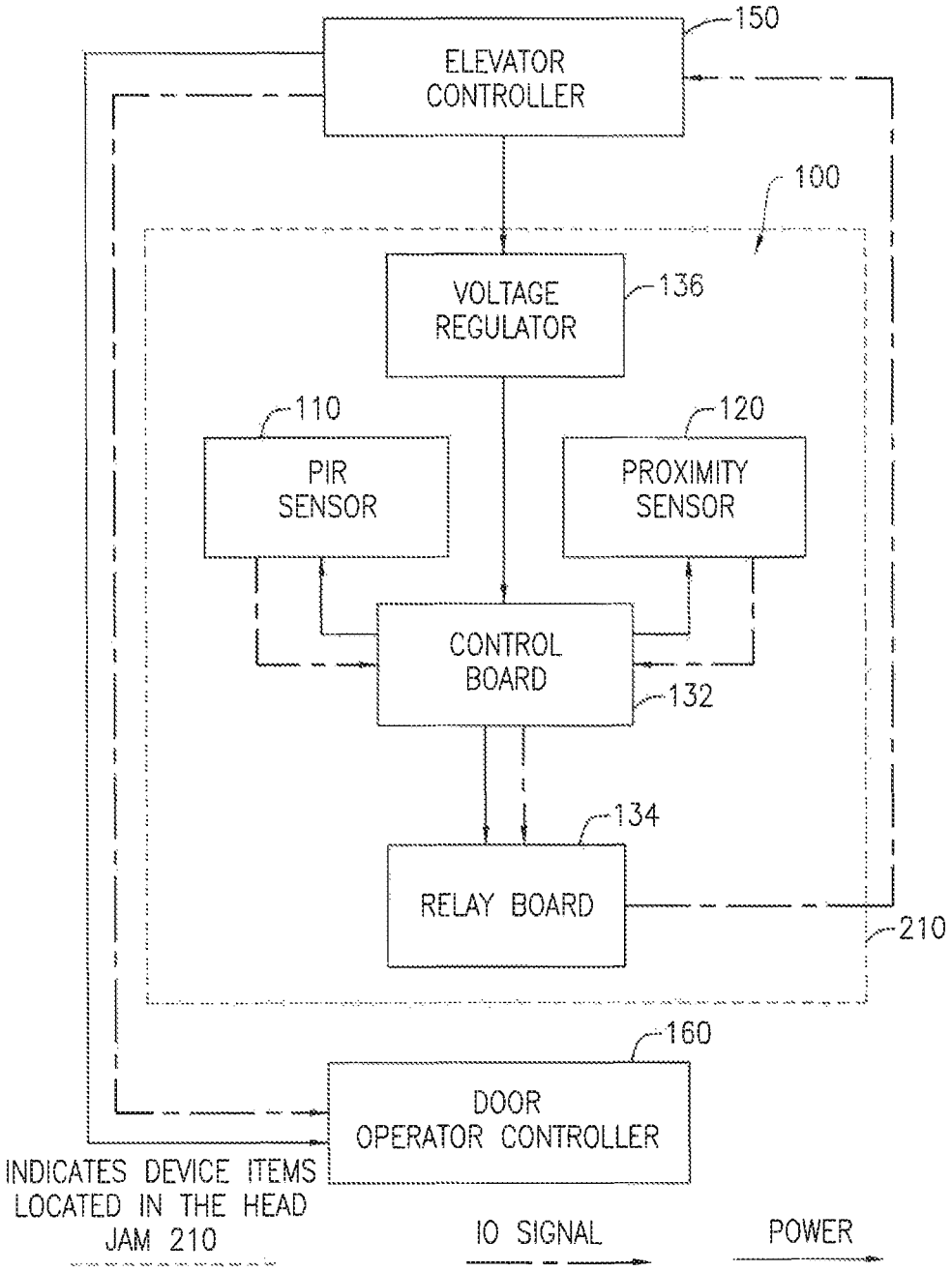
FIG. 3 shows a block diagram of a control system of the elevator door safety system 100.

FIG. 3 shows the connections in the system 100. The elevator controller 150 provides power to and controls all operations of the elevator and related devices including a door operator controller 160. The door operator controller 160, which is mounted on the elevator cab 270, opens and closes the car door and entrance door 240 panel(s) based on information from the system 100. In one embodiment, the elevator operates via the system 100, which include the motion sensor 110, the proximity sensor 120, the control board 132, the relay board 134 and the voltage regulator 136. As shown in FIG. 2 the system 100 is disposed in the head jamb 210. In another embodiment, and when needed, the proximity sensor 120 may be mounted at the strike jamb 230 instead of the head jamb 210.

The elevator controller 150 provides 24 vdc of power to the voltage regulator 136. The voltage regulator 136 converts the 24 vdc into 5 vdc, which is then used to power the other components: motion sensor 110, the proximity sensor 120, the control board 132, and the relay board 134. The control board 132 contains and runs a continuous loop software with a preset timer to determine if what is being detected in the entrance area 260 is a moving person or object. If needed, the preset timer in the software can be customized either by pre-programming or by being changed in the field using a programming interface. The control board 132 then powers other boards: the motion sensor 110, the proximity sensor 120, and the relay board 134. It should be noted that in another embodiment the motion sensor 110, the proximity sensor 120, and relay hoard 134 may be used without the Voltage Regulator 136, Control board 132 or software.

In one embodiment, the motion sensor 110 is any sensor that detects motion such as but not limited to a pyroelectric infrared (PIR) sensor, radar, sonar or LED sensors, Continuing to describe the system 100 the motion sensor 110 will be described using a PIR sensor. The PIR type motion sensor 110 contains two balanced differential elements connected in series and configured as opposed types such as an infrared emitter and receiver with focused lenses. In one embodiment, the elements may be optically enhanced using a Fresnel lens to increase the size of a detection area.

The motion sensor 110 projects sensing means into a pre-defined area or projection/detection area 340 to detect movement through the aperture plate 146 or aperture box 140. Here with the PIR type motion sensor 110 infrared light waves are projected. Specifically, the emitter sends infrared light pulses in the direction of the object to be detected. The receiver is preset to detect a specific level of infrared light. The pulses from the emitter are sensed by the receiver when the light intensity reflected off of an approaching object reaches a preset threshold. Both elements detect a predefined range of heat radiation wave lengths. In one embodiment, the PIR type motion sensor 110 detects about ten microns of heat radiation wave lengths. The differential elements in the PIR type motion sensor 110 are balanced when no movement is detected. When the differential elements become unbalanced, for instance when one element detects a radiation change before the other element, then movement is detected. During an unbalanced state the sensor emits a positive or negative output to a decoder or a microprocessor unit within the PIR type motion sensor 110.

The decoder is designed to detect a difference in the differential elements and is in constant communication with control board 132. In some embodiments, the decoder is a preset timer used to determine the length of time when an imbalance between the differential elements qualifies for re-opening the door 240. For instance, if the imbalance is less than $1/10^{th}$ of a second then the door will close and vice versa.

Continuing with the PIR type motion sensor 110, to adjust for variances, the system 100 may employ a sensitivity adjustor on a circuit board of the PIR type motion sensor 110. The sensitivity adjustor increases or decreases the sensitivity of the PIR sensor. In one embodiment the sensitivity adjustor maybe a potentiometer. The sensitivity adjustor will adjust sensitivity of the PIR type motion sensor 110. Some reasons for making such adjustments in the entrance area 260 include but are not limited to high or low temperature extremes, sunlight exposure and/or the amount of foot traffic in an adjoining lobby or hallway. With the sensitivity adjustor located on the PIR Sensor circuit board, the level of sensitivity of the system 100 customized for each floor. In practice, in one embodiment, the sensitivity level of the system 100 will be adjusted by removing aperture plate 146 and PIR sensor 110 and then turning the potentiometer with a small screwdriver.

The proximity sensor 120 determines the status of the door, whether the door is open, closed or in motion to either open or close. The proximity sensor 120 then communicates this status to the control board 132. The control board 132, motion sensor 110 and proximity sensor 120 are always active at all elevator entrances 200 in a building and the control board 132 is in constant communication with each the motion sensor 110 and proximity sensor 120. The control board 132 manages the information from the motion sensor 110 and proximity sensor 120 and determines if the control board should give directions to the relay board 134.

For instance, if the motion sensor 110 senses a person but the proximity sensor 120 states the door 240 is closed the control board 132 ignores the signal from the motion sensor 110. If, however, the motion sensor 110 senses a person and the proximity sensor 120 states the door is closing, but not yet closed, the control board 132 will send the signal from the motion sensor 110 to the relay board 134 and the elevator controller 150 will respond by having door operator controller re-open the door 240. If door panel 240 is in the full-open position the control board 132 will relay the signal to the relay board 134 which then conveys the signal to elevator controller 150 that responds by delaying the close signal to the elevator door operator controller 160.

The relay board 134 is an output board with Normally Open or Normally Closed contacts that are configured per job to change the state of a Car Door Light screen input on a standard elevator controller 150. In one embodiment, the output from the relay board 134 is connected to the same input on the elevator controller 150 as the car door light screen thus eliminating the need for an additional input. In this embodiment, when the output from the relay board 134 is performing the same function as the car door light screen there is no reason for a separate input. In another embodiment, if a separate input is required the system 100 would be used with compatible elevator controllers.

The relay board 134 is not active on any floors where the door 240 is closed. The output from the relay board 134 is connected in series or parallel with the car door light screen to an input on the elevator controller 150. In this embodiment, the Fire Service function is not affected since using the same input on the elevator controller 150 turns off both the car door light screen and system 100 in the event of a fire to keep smoke from causing the doors 240 to stay open. Likewise, in this embodiment, a Nudge function or Nudge speed rational is not affected, Here, if a person remains in the detection zone of the car door light screen or in the projection area 340 of the system 100 for 20-30 seconds the Nudge function is activated, Upon activation of the Nudge function, the elevator controller 150 ignores the car door light screen input, an audible alert is sounded and the door 240 closes at a reduced speed to avoid injury.

Figure 4:
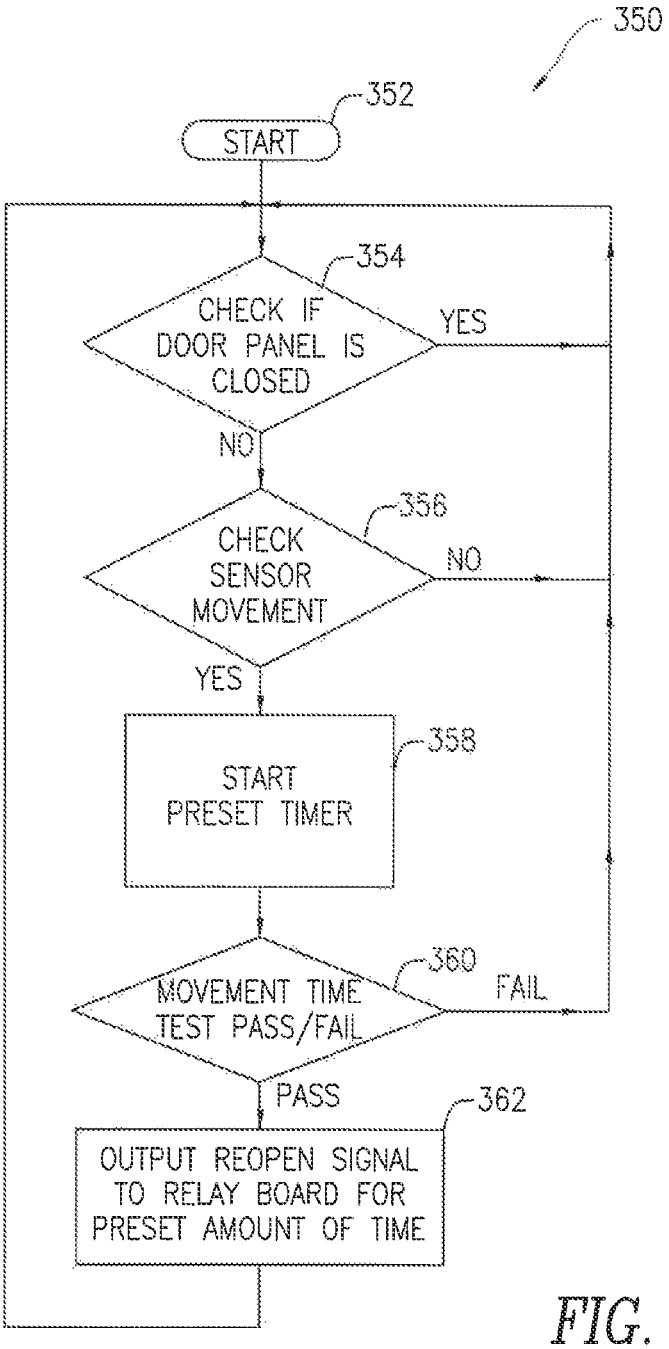
FIG. 4 shows logic flow chart of system 100.

FIG. 4 shows the logic 350 of the system 100. At the start 352 of the loop of the software, the system 100 checks the proximity sensor 120 to see if the door panel 240 is closed, see step 354. If the proximity sensor 120 senses the door panel 240 is in the full closed position, the system software loops up to the start and the signal from motion sensor 110 is ignored until the next software loop. If instead, the proximity sensor 120 senses the door panel 240 is not in the full closed position, then the software checks to determine if the movement is a person or a false trigger. If the door panel 240 is not closed and there is no false trigger, the system software moves to step 356.

Step 356 asks if the motion sensor 110 senses movement. If there is no movement sensed, the system software loops to the start. However, if sensor 110 senses movement, the preset timer is started, see step 358. Once the timer is started, step 360 determines if the movement is detected and surpasses the preset time. If both movement is detected and the preset time is surpassed, then a pass is earned and the system software moves to step 362 and the control board relays the signal to the relay board 134 to keep the door 240 open for a preset amount of time. If, however, at step 360, the movement detected is below the threshold preset time, then there is a fail and the system software loops back to the top.

Figure 5A:
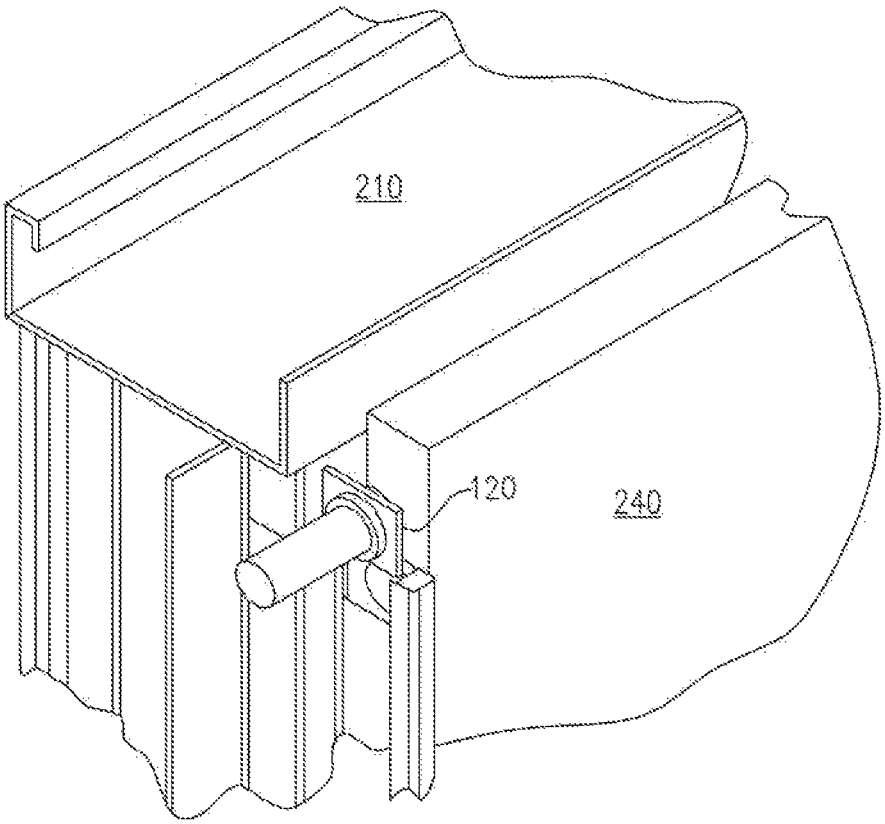
FIG. 5A shows an alternate location for a proximity sensor.
Figure 5B:
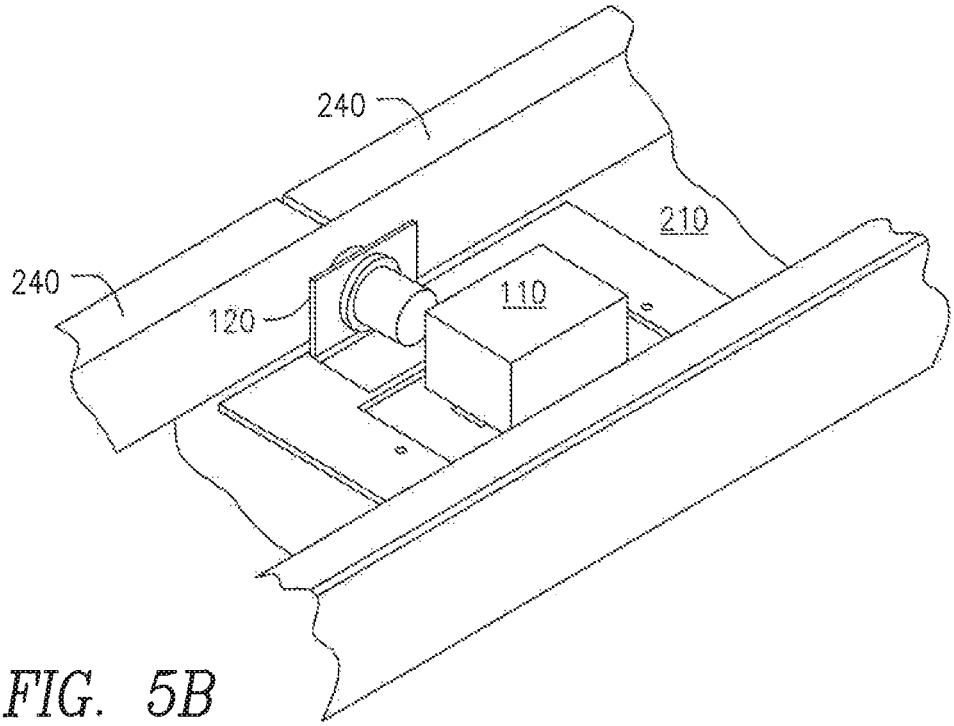
FIG. 5B shows an elevator door safety system 100 of the present invention using a double-slide type of door opening.

The description above is shown with a single-slide type door 240 with proximity sensor 120 disposed in the head jamb 210. The sensor 120 may be at the end of the head jamb or outside the head jamb and placed on the strike jamb 230. See FIGS. 1A and 5A, respectively. As shown in FIG. 5B, the system 100 may be employed with double-slide type of doors 240 wherein both the sensors 110, 120 are disposed in the center of the head jamb 210.

The system 100 of the invention uses a single sensor 110 for motion detection in the entrance area 260 to simplify adjustment, maintenance and troubleshooting ability. Standard components not specific to the elevator industry are integrated in this design to keep cost low and increase availability therefore allowing for replacements to be stocked on site or by technicians. Because this invention is designed to be an enhancement to the current safety and protection practices, elevator operation is not suspended in the event of sensor 110 failure. The single sensor 110 can be easily replaced by removing plate 146 in the head jamb 210. In some embodiments, these features are useful in high-speed high-volume elevators to greatly reduce down time needed for servicing elevators.

While specific embodiments of the invention have been described and illustrated, such embodiments should be considered illustrative of the invention only and not as limiting the invention as construed in accordance with the accompanying claims. One of ordinary skill in the art could alter the above embodiments or provide insubstantial changes that may be made without departing from the scope of the invention.

I claim:

1. An elevator door safety system comprising:

an elevator entrance assembly;

a motion sensor disposed in the entrance assembly, said motion sensor detecting presence of at least one person in an entrance area; and a proximity sensor, the proximity sensor monitoring status of an elevator door;

wherein the status of an elevator door determines if the presence of the person will open the elevator door.

2. The system of claim 1, wherein the entrance assembly is fire-rated and includes a head jamb and a strike jamb.

3. The system of claim 1, wherein the motion sensor is a PIR.

4. The system of claim 1, wherein the motion sensor is a PIR, said PIR further includes a sensitivity adjustor.

5. The system of claim 1, wherein said proximity sensor sends signals to a control board on the status of the door, wherein when the door is closed, said proximity sensor signals override PIR signals sent to the control board and the door remains closed.

6. The system of claim 1, wherein said proximity sensor sends signals to a control board on the status of the door, wherein when the door is not closed, said proximity sensor signals allow the PIR signals to be sent to the control board, the control board analyzes said proximity sensor signals and said PIR signals to determine whether to open the door.

7. The system of claim 1, wherein the entrance area includes a detection area, the detection area being a distance to a maximum area in the entrance area in Which the motion sensor detects the presence of the person.

8. The system of claim 7, wherein the detection area is measured starting from a hallway facing surface of an entrance jamb.

9. The system of claim 7, wherein the maximum area in the entrance area of the detection area is about 12" from a hallway-facing surface of the entrance jamb.

10. The system of claim 7, wherein the maximum area in the entrance area of the detection area being defined by ASME code and being measured from the hallway-facing surface of the entrance jamb.

11. The system of claim 1, further comprising a control board, said control board containing and running a continuous loop software with a preset timer, said control board determining if the motion sensor is detecting a moving person or object.

12. The system of claim 1, further comprising an adjustor, the adjustor defining a detection area, the detection area being a maximum area in which the motion sensor detects the presence of the person.

13. The system 1, wherein the proximity sensor is disposed in a head jamb of the entrance assembly.

14. The system of claim 1, wherein the proximity sensor is disposed in a strike jamb of the entrance assembly.

15. A method of controlling an elevator door comprising:

providing a motion sensor disposed on an elevator entrance assembly, said motion sensor detecting presence of at least one person in a detection area, said motion sensor sending signals based on the detecting of the person to a control board; and providing a door sensor, said door sensor detecting status of the door, said door sensor sending signals based on the status of the door to the control board, wherein the motion sensor signals are bypassed by the control board when the door sensor sends door closed signals to the control board, wherein the motion sensor signals are relayed to an elevator controller by the control board when the door sensor sends door-not-closed signals to the control board whereby the door opens.

16. The method of claim 15, wherein the entrance assembly is fire-rated and said entrance includes a head jamb and a strike jamb.

17. The method of claim 15, wherein the detection area is defined as a distance from a hallway-facing surface of the entrance jamb to a maximum area in the entrance area in which the motion sensor detects the presence of the person.

* * * * *